US007097721B2

(12) United States Patent
Norris

(10) Patent No.: US 7,097,721 B2
(45) Date of Patent: Aug. 29, 2006

(54) GAS BLAST LABEL APPLICATOR

(75) Inventor: Howard Norris, Tauranga (NZ)

(73) Assignee: Jetstick Limited, Edgecumbe (NZ)

( * ) Notice: Subject to any disclaimer, the term of this patent is extended or adjusted under 35 U.S.C. 154(b) by 15 days.

(21) Appl. No.: 10/325,829

(22) Filed: Dec. 23, 2002

(65) Prior Publication Data

US 2004/0011469 A1 Jan. 22, 2004

Related U.S. Application Data

(63) Continuation of application No. PCT/NZ01/00120, filed on Jun. 22, 2001.

(30) Foreign Application Priority Data

Jun. 23, 2000 (NZ) ..... 505378

(51) Int. Cl.
*B65C 9/00* (2006.01)
*B65C 9/18* (2006.01)
*B65C 9/28* (2006.01)

(52) U.S. Cl. ..... 156/64; 156/247; 156/497; 156/541; 156/542; 156/566; 156/DIG. 33; 156/DIG. 38

(58) Field of Classification Search ..... 156/538–542, 156/497, DIG. 38, 556, 566, DIG. 44, DIG. 27, 156/DIG. 24, 247–249, DIG. 33, 64; 269/21, 269/96, 195
See application file for complete search history.

(56) References Cited

U.S. PATENT DOCUMENTS

| | | | | |
|---|---|---|---|---|
| 3,645,832 | A * | 2/1972 | Sauer | 156/541 |
| 4,479,839 | A * | 10/1984 | Tasma | 156/542 |
| 4,676,859 | A * | 6/1987 | Cleary et al. | 156/541 |
| 4,680,082 | A | 7/1987 | Kearney | 156/497 |
| 5,149,392 | A | 9/1992 | Plaessmann | 156/542 |
| 5,232,540 | A | 8/1993 | Southwell et al. | 156/361 |
| 5,730,816 | A | 3/1998 | Murphy | 156/64 |
| 5,885,406 | A * | 3/1999 | Tiefel | 156/542 |
| 5,954,913 | A | 9/1999 | Wurz et al. | 156/360 |

* cited by examiner

*Primary Examiner*—Sue A. Purvis

(74) *Attorney, Agent, or Firm*—Lowe Hauptman & Berner, LLP

(57) ABSTRACT

An air blast applicator for applying adhesive-backed labels (2) includes a peel knife (13) for sequentially partially peeling successive labels from a backing strip (6). A gas stream (28) is directed at each label passing to the peel knife (12) to assist removing it and prevent it reattaching to the backing strip (6). An air amplifier (25) has a tube therein such that a gas flow through the tube causes air to be drawn through the air amplifier (25) inducing the air flow (28) directed at the label (2). A blast (20) of gas applies each label (2).

7 Claims, 3 Drawing Sheets

GAS BLAST LABEL APPLICATOR

RELATED APPLICATION

This application is a continuation of International Application No. PCT/NZ01/00120, filed Jun. 22, 2001.

FIELD OF THE INVENTION

This invention is directed to improvements in and relating to the application of adhesive labels on to objects. In particular, the invention relates to gas blast applicators for adhesive labels and the methods and apparatus of this invention have particular use in relation to the application of labels on to fruit either singularly, or via multiple application to all fruit positioned in a fruit tray.

BACKGROUND OF THE INVENTION

Gas blast label applicators are known from the prior art and are typically used for labelling items which pass beneath the applicator on a conveyor. Using the gas blast avoids contact with sensitive items such as fruit which may be damaged by direct contact applicators. In these devices a label strip is passed around a peel knife to remove successive adhesive-backed labels fixed thereto and present each label to an applicator head against which the label is held by a vacuum. When a detector indicates the presence of the object to be labelled a gas blast is used to apply the label. For economic high speed application of labels to relatively inexpensive bulk items (such as fruit, for example) the capital cost of the labeller must be as low as possible.

U.S. Pat. No. 5,954,913 describes an applicator where the applicator head may be automatically raised and lowered depending upon the size of the object to be labelled. In this device the partial vacuum drawn through the applicator head is supplied in the manner of the prior art, such as by connection to a vacuum reservoir/vacuum pump. The complexity and consequent high manufacturing cost of this machine, including costly items such as vacuum pumps and reservoirs makes it unsuited for use in labelling bulk items.

It is an object of the present invention at least to address the foregoing problems or to provide the general public with an alternative system.

Further aspects and advantages of the present invention will become apparent from the ensuing description that is given by way of example only.

SUMMARY OF THE INVENTION

According to one aspect of the present invention there is provided labelling apparatus for applying a label to an object, the apparatus including:

a driving mechanism for advancing a label strip, the label strip comprising at least one self-adhesive label applied to a non-adhesive backing strip, the driving mechanism feeding the label strip towards and presenting each label at a delivery point;

a label sensing means for sensing the end of the label;

a detaching apparatus located at the delivery point for partially detaching each label from the backing strip;

an air amplifier located at the delivery point; an inlet for blowing air into the air amplifier to induce a first air flow directed at the label to prevent the label reattaching to the backing strip and wherein when the label sensing means senses the end of the label, a secondary flow through the air amplifier provides a blast of air delivered onto the label to force the label to attach to the object.

The apparatus may further include an object detector capable of detecting the size of the object to which the label is to be applied for controlling the actuation of the apparatus. This object detector may in some embodiments be a photoelectric sensor. In other embodiments, an external signal may provide the apparatus with an indication of the size of the object. The object detector may be positioned at the front of the apparatus. These may be synchronised by a shift register in a regulating electronic control board to allow the position of the object to be determined without the object crowding the area around the label application station.

The label strip comprising the backing strip with the labels affixed thereto may be guided by pulley systems to engage at least one drive wheel that is capable of driving the label strip in a substantially forward direction. The drive wheel may be turned until one complete label has passed the label sensing means monitoring the position of successive labels relative to the position of the object to be labelled.

Once the label strip has passed the label sensing means the label strip is forced over a detaching apparatus or peel knife in a manner that only partially detaches the label from the backing tape.

However, in some other preferred embodiments of the present invention, the action of the moving backing tape is utilized to detach the label from the label strip.

The labelling apparatus may be operated by any one of a reticulated air supply, individual air compressors, or any other means capable of providing at least one pressurized air flow when required.

According to another aspect of the present invention there is provided a method of using a labelling apparatus to apply a label to an object, comprising:

providing at least one label on a backing strip;

feeding the backing strip in a direction so as to present the or each label, in sequence, at a delivery point by way of a drive mechanism;

forcing the label strip over a detaching apparatus so as to partially detach the label at the delivery point from the backing strip;

blowing air into inlet of an air amplifier at the delivery point to induce a first air flow directed at the label to prevent the label reattaching to the backing strip sensing that the end of the label has fully detached from the backing strip;

deactivating the first air flow and activating a secondary air flow through the air amplifier to force the label onto the object.

Preferred embodiments of the present invention require a readily available label source, such as a spool onto which a label strip is fitted. The label strip includes a number of self-adhesive labels applied to a non-adhesive backing strip.

During operation the labelling apparatus feeds the label strip from the label spool to a delivery point from where the label is delivered to the object when required.

As will be appreciated, any suitable substitution to the above may be adapted for use with the present invention.

To ensure the label strip is ideally presented to the delivery point the labelling apparatus includes a driving mechanism. The driving mechanism preferably includes at least one pulley to assist in feeding the label strip in a preferred direction and at a preferred tension in order to enable the labels to be correctly presented at the delivery point.

The driving mechanism also therefore includes at least one drive wheel and at least one pressure wheel, which is used to apply the required frictional force against the label strip and the drive wheel, both to facilitate movement of the label source from the label spool and to ensure that the label is delivered at the appropriate time.

The label sensing means is located at an appropriate point along the route of the label to the delivery point.

In preferred embodiments the label sensing means includes a label photo-sensor, although this should not be seen to be a limitation on the present invention in many way as any suitable sensing apparatus may be employed with the invention.

The label-sensing photo-sensor monitors the position of the label with respect to the position of the object to which the label will be applied.

In preferred embodiments of the present invention, a drive wheel is turned until one complete label has passed the label-sensing photo-sensor.

A stepper motor is utilized at this point in the apparatus in order to compensate for the inherent high detent force and therefore prevent overrun of the label. Any suitable compensation means may be employed although a stepper motor is preferred. Operation of the drive wheel in conjunction with the stepper motor accurately presents the label to the delivery point.

Within the present specification the labelling process is triggered by one of two things, either the object detector detects an object or the apparatus receives a signal indicative of the object's size.

The first air source is preferably provided as a flow of air through an air amplifier. A tube is fitted inside the air amplifier and close to where the label is detached as air blowing out of the tube causes air to be drawn through the air amplifier. The air drawn through the air amplifier results in a flow of air which is blown at the label preventing the label from re-attaching itself to the backing strip.

As is well known in the art, an air amplifier is a component of a pneumatic system designed to increase the magnitude of a flow by releasing small amounts of compressed air at high velocity through an internal, ring shaped nozzle, or the like. This column of air released through the front creates a vacuum behind, thus pulling ambient air through the rear and pushing ambient air in front.

When the electronic sensing apparatus of the invention senses that the end of the label has passed a certain point a second air flow is activated and the primary air source can be turned off. The second air flow is emitted from the air amplifier and forces the label onto the object.

The air supply changeover from the primary air source to the blast means is preferably effected by a five port air valve.

After the label has been detached from the backing strip, the backing strip may travel over and around the peel knife and may be directed away from the delivery point past the drive wheel and to a backing spool around which the backing strip is fed and retained.

Tension is preferably maintained on the backing strip during its delivery to the backing spool via a pressure wheel forcing the backing strip against the drive wheel. The empty backing strip may be rewound via operation of a low power, low speed motor.

The above sequence can be repeated as many times as required to apply the labels to the number of objects requiring labelling.

As can be appreciated, variations are possible to the componentry of the above apparatus. For example, the stepping motor driving the drive wheel may be air operated, hydraulic, or any geared electric motor.

The pulleys or idling points may be other structures than pulley wheels, for instance they may be solid bars and so forth.

Although it is envisaged a reticulated air supply will be available to drive the labelling apparatus it should be appreciated that individual air compressors or any other suitable form of air supply may be used.

Preferably all framework associated with the invention is of mild steel. The pulleys are preferably plastic but could also be metallic or manufactured from any other suitable material, as may be the tension wheels or the drive wheel (which is preferably made of aluminium).

It should also be appreciated that there are a number of alternative uses for the invention inasmuch as almost any label applicator could benefit from the principles of this invention. The air application enables irregular objects to be more easily labelled.

In addition, with only a few moving parts a greater speed of operation is easier to achieve. Without direct physical contact of the applicator onto an object such as fruit, problems of bruising or other damage are minimized.

The labelling apparatus may used to apply labels to individual fruit/objects, or an entire tray of fruit may be labelled a row at a time or, by other modifications to the invention, tray at a time.

Accordingly, the terminology or description herein should not be seen to limit the scope of this invention.

BRIEF DESCRIPTION OF DRAWINGS

Further aspects of the present invention will become apparent from the following description which is given by way of example only and with reference to the accompanying drawings in which.

DETAILED DESCRIPTION OF PREFERRED EMBODIMENT OF THE INVENTION

Figure 1:
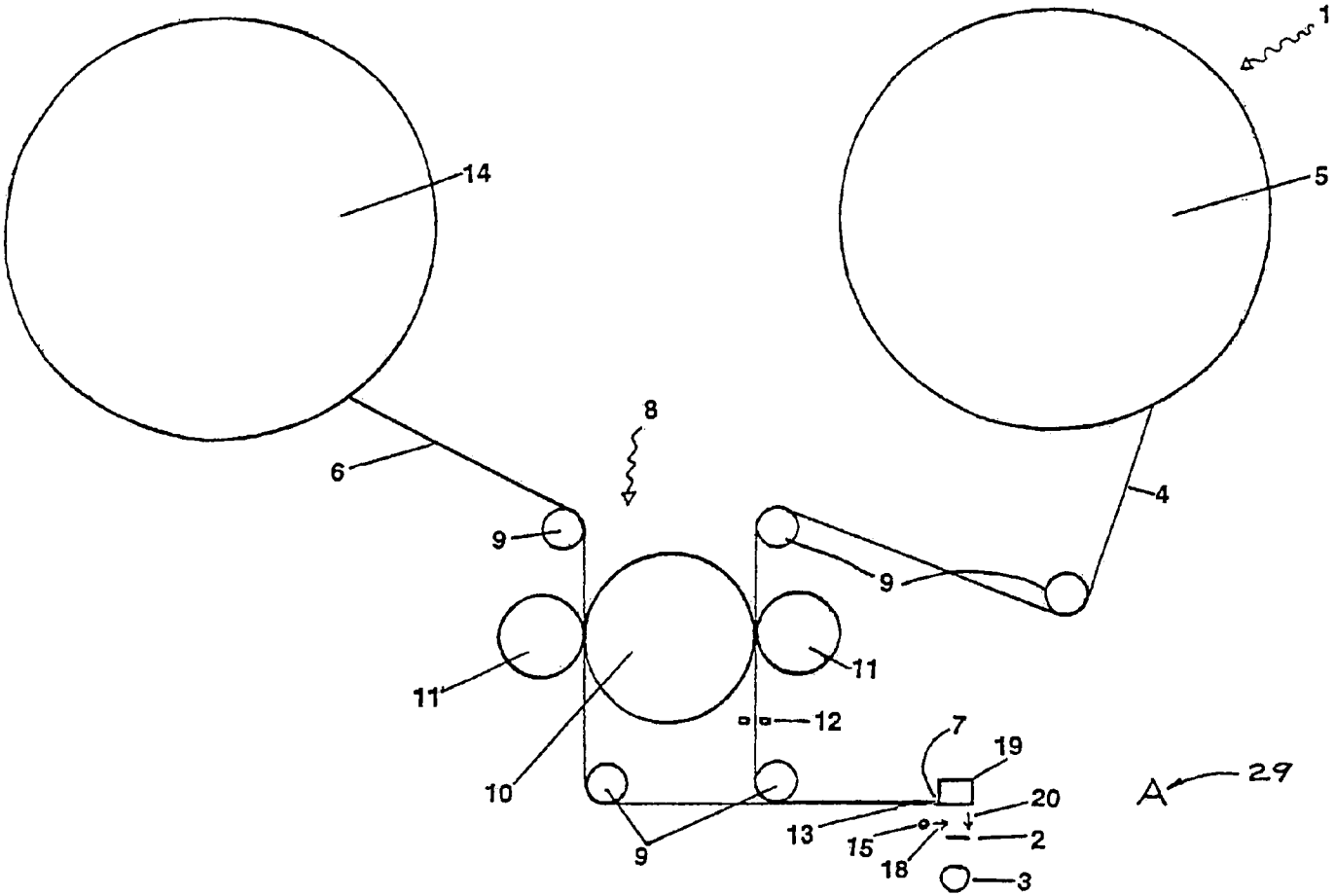
FIG. 1 is a diagrammatic side view of the labelling apparatus in accordance with a first preferred embodiment of the present invention.

With reference to the diagrams by way of example only there is provided a label applicator or labelling apparatus (generally indicated by arrow 1) for applying a label 2 to an object 3.

The process of delivering label 2 to object 3 is triggered by one of two things. A photo-electric sensor 29 detects an object 3 and provides a signal for controlling the application of each label, alternatively the signal may come from a host sizer computer (not shown). Labelling apparatus 1 is timed to the sizing computer/machine by the same or additional sensing apparatus linked to or separate from the photo-electric sensor that detects the object.

The object detector is positioned at the front of labelling apparatus 1 and is synchronized by a shift register in the electronic control board of the object detector, to allow the position of object 3 to be determined, without object 3, or the object detector crowding the area around the delivery point 7 at which label 2 is applied to each of a plurality of objects 3.

Labels 2 are supplied on a label strip 4 comprising a backing strip 6 to which respective adhesive faces (not shown) of consecutive labels 2 are initially adhered. Each label 2 has a display face (not shown) opposing its adhesive face. During operation, the labelling apparatus 1 operates to feed label strip 4 from a spool 5 to a delivery point 7 where label 2 is delivered to object 3.

Label sensing means 12 is included along the delivery route of label strip 4 as label strip moves towards delivery point 7 for sensing the position of successive labels 2. Label sensing means 12 includes a photo-sensor to monitor the position of the label ultimately relative to the position of object 3 to which label 2 will be applied. Not shown in FIG. 1 is a stepper motor employed at this point in the apparatus. The stepper motor is required because of the inherent high detent force to prevent overrun of the label. As can be appreciated, variations are possible to the componentry of the above apparatus. For example, the stepping motor, driving the drive wheel 10, may be air operated, hydraulic, or any geared electric motor.

To ensure label strip 4 is ideally presented to delivery point 7 the apparatus includes a driving mechanism 8. Driving mechanism 8 includes multiple pulleys/idling points 9 to direct the label strip, and pressure wheels 11 to maintain tension on label strip 4 to enable label strip 4 to be optimally presented at delivery point 7. The driving mechanism 8 also includes a drive wheel 10 that co-operates with the at least two pressure wheels 11 to force label strip 4 against drive wheel 10 to facilitate movement of label strip 4 from the label spool 5. The pulleys or idling points 9 may be other than pulley wheels and may, for example be solid bars and so forth.

Operation of drive wheel 10 cooperates with the stepper motor (not shown) of the a driving mechanism 8 to sequentially present each label 2 to delivery point 7. Drive wheel 10 is turned until one complete label 2 has passed the label photo-sensor 12.

At delivery point 7 there is included a peel knife 13. Label strip 4 is forced over peel knife 13 such that a label 2 becomes partially detached from backing strip 6.

As label 2 is partially detached from backing strip 6 (at the delivery point 7, a primary air source 15 is activated. This primary air source 15 assists with the removal of label 2 and prevents the label 2 from re-attaching itself to the backing strip 6.

Figure 2:
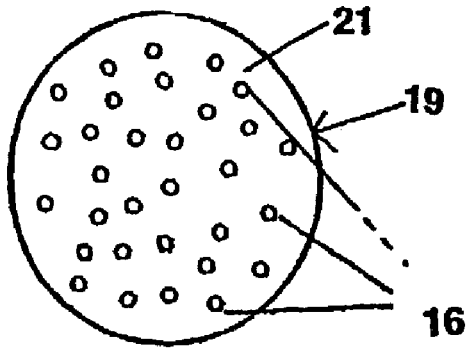
FIG. 2 is a diagrammatic plan view of the secondary air source of the apparatus of FIG. 1.
Figure 3:
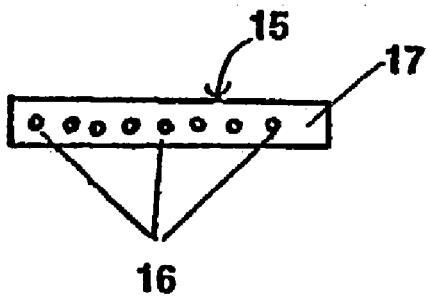
FIG. 3 is a diagrammatic top plan view of the side surface and the air jets from the side of the primary air source of the apparatus of FIG. 1.

In a first preferred embodiment illustrated in FIGS. 1–3, primary air source 15 provides an air curtain through multiple air jets 16 arranged along a side surface of primary air source 15. FIG. 3 illustrates a top plan view of primary air source 15 showing that multiple air jets 16 arranged substantially linearly along the side surface 17 of primary air source 15. As can be appreciated however, the arrangements of air jets 16 can be varied as required as can the number of air jets, or their position on or around the primary air source. The air passing through air jets 16 of primary air source 15 results in an air curtain the direction of which is shown at arrow 18. Effectively, air curtain 18 produced by primary air source tube 15 and its associated apertures/holes 16, operates like a flute, and blows air across label 2 preventing the label from re-attaching itself to backing strip 6.

The action of the air also forms an area of low pressure beneath the air nozzle 19.

The air nozzle 19 provides a blast of air to apply each label 2, pressing its adhesive face against object 3. The offset knife 13/air nozzle 19 configuration causes the trailing edge of label 2 to detach from the backing strip 6 because of tension created by label 2 bending.

When electronic sensing apparatus senses the end of the label transfer, primary air source 15 and correspondingly the air stream 28 is turned off, and an air blast is supplied via air nozzle 19.

The bottom surface of the air nozzle 19 includes multiple holes 16 through which the air is directed downwardly. Air is blown out of air nozzle 19, in direction 20. The air blast from air nozzle 19 forces label 2 onto object 3. The delivery blast is intermittent, the duration of which is sufficient to deposit successive labels onto the surface of the object positioned beneath the nozzle 19.

A five port air valve effects the air changeover between the primary and secondary air sources. Although it is envisaged that a reticulated air supply will be available to drive labelling apparatus 1, it should be appreciated that individual air compressors could also be used.

Label strip 4 then travels over and around peel knife 13 and at this stage the remaining backing strip is directed away from delivery point 7 passed the drive wheel 10 and to backing spool 14 around which backing strip 6 is received and retained. The empty backing strip 6 is rewound onto backing spool 14 via operation of a low power, low speed motor (not shown).

Again, tension is maintained on the backing strip 6 during its delivery to backing spool 14 as a result of the positioning of various pulleys/idling points 9 and by a pressure wheel 11. Pressure is applied by pressure wheel 11 to backing strip 6 fed between pressure wheel 11 and the drive wheel 10.

The above sequence is repeated as many times as required to apply the labels 2 to the number of objects 3 requiring labelling. Almost any label applicator 1 could benefit from the principles of this invention. The air application enables irregular objects 3 to be easier to label. In addition, few moving parts mean speed of operation is easier to achieve. Also as can be appreciated there are a number of alternative uses for the invention whether the labels are applied to single objects sequentially, or multiple objects at the same time.

Preferably all frame work is of mild steel, the pulleys are preferably plastic but could also be metallic or any other suitable material, as may be the tension wheels or the drive wheel (the latter of which is preferably made of aluminium).

Figure 4:
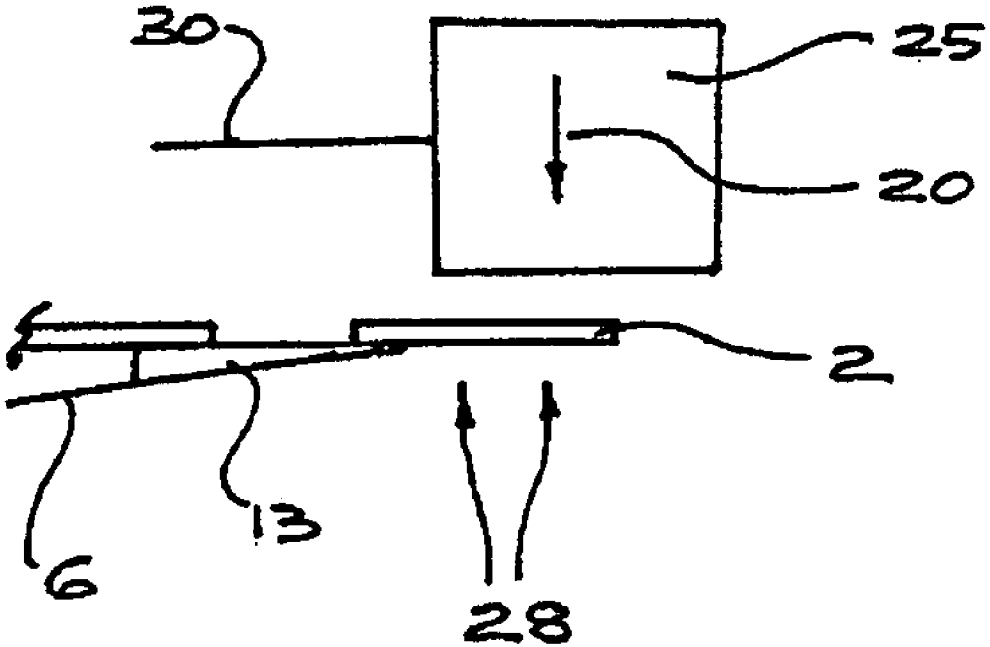
FIG. 4 is a sectional view illustrating an air amplifier of a second preferred embodiment of the present invention.

In a second preferred embodiment illustrated in FIG. 4, a tube (30) is fitted inside the air amplifier (25) and air blowing out of the tube (30) causes air to be drawn through the air amplifier (25). The air drawn through the air amplifier (25) results in a flow of air (28) which is blown at the label preventing the label from re-attaching itself to the backing strip (6). When the label-sensing means (12) senses that the end of the label has passed a certain point a second air flow (20) is activated and the primary air from the tube (30) can be turned off. The second air flow is emitted from the air amplifier (25) in a blast that forces the label (2) onto the object (3).

Aspects of the present invention have been described by way of example only and it should be appreciated that modifications and additions may be made thereto without departing from the scope of the amended claims.

I claim:

1. A method of using a labeling apparatus to apply a label to an object, said method comprising:

providing at least one label on a backing strip;

feeding the backing strip in a direction so as to present the or each label, in sequence, at a delivery point;

forcing the label strip over a detaching apparatus so as to partially detach the label at the delivery point from the backing strip;

blowing air into an inlet of an air amplifier at the delivery point to induce a first air flow directed at the label to prevent the label reattaching to the backing strip;

sensing that the end of the label has fully detached from the backing strip; and deactivating the first air flow and activating a secondary air flow through the air amplifier to force the label onto the object.

2. A labeling apparatus for applying a label to an object, the apparatus comprising:

a driving mechanism for advancing a label strip, the label strip comprising at least one self-adhesive label applied to a non-adhesive backing strip, the driving mechanism feeding the label strip towards and presenting each label at a delivery point;

label sensing means for sensing the end of the label;

a detaching apparatus located at the deliver point for partially detaching each label from the backing strip;

an air amplifier located at the delivery point; and an inlet for blowing air into the air amplifier to induce a first air flow directed at the label to prevent the label reattaching to the backing strip;

wherein when the label sensing means senses the end of the label a secondary flow through the air amplifier provides a blast of air delivered onto the label to force the label to attach to the object; and wherein the inlet for blowing air into the air amplifier includes a tube fitted inside the air amplifier.

3. The apparatus of claim 2, further comprising a valve which changes air supply from the inlet for blowing air into the air amplifier to induce a first air flow to the secondary flow for providing the blast through the air amplifier.

4. The apparatus of claim 2, further comprising an object detector for detecting the position of the object to which a label is to be applied, the detector applying a signal for controlling the application of each label.

5. A labeling apparatus for applying a label to an object, the apparatus comprising:

a driving mechanism for advancing a label strip, the label strip comprising at least one self-adhesive label applied to a non-adhesive backing strip, the driving mechanism feeding the label strip towards and presenting each label at a delivery point;

a label sensor or sensing the end of the label;

a detaching apparatus located at the delivery point for partially detaching each label from the backing strip;

an air amplifier located at the delivery point; and an inlet for blowing air into the air amplifier to induce a first air flow directed at the label to prevent the label reattaching to the backing strip;

wherein when the label sensor senses the end of the label a secondary flow through the air amplifier provides a blast of air delivered onto the label to force the label to attach to the object; and wherein the inlet for blowing air into the air amplifier includes a tube fitted inside the air amplifier.

6. The apparatus of claim 5, further comprising a valve which changes air supply from the inlet for blowing air into the air amplifier to induce a first air flow to the secondary flow for providing the blast through the air amplifier.

7. The apparatus of claim 5, further comprising an object detector for detecting the position of the object to which a label is to be applied, the detector supplying a signal for controlling the application of each label.

* * * * *